US006688021B2

(12) United States Patent
Baig et al.

(10) Patent No.: US 6,688,021 B2
(45) Date of Patent: Feb. 10, 2004

(54) LOCOMOTIVE SNOW REMOVAL ENHANCEMENT

(75) Inventors: Mirza Aref Ahmed Baig, Erie, PA (US); Admir Mesalic, Fort Worth, TX (US); Ryan Eric Perry, Oil City, PA (US)

(73) Assignee: General Electric Company, Schenectady, NY (US)

( * ) Notice: Subject to any disclaimer, the term of this patent is extended or adjusted under 35 U.S.C. 154(b) by 96 days.

(21) Appl. No.: 09/838,651

(22) Filed: Apr. 19, 2001

(65) Prior Publication Data

US 2002/0170207 A1 Nov. 21, 2002

(51) Int. Cl.[7] ..... E01H 8/04
(52) U.S. Cl. ..... 37/214; 104/279
(58) Field of Search ..... 37/198, 203, 214, 37/215, 216, 217, 233; 104/279; 15/256.5

(56) References Cited

U.S. PATENT DOCUMENTS

| | | | | | |
|---|---|---|---|---|---|
| 104,113 | A | * | 6/1870 | Churchman | 37/214 |
| 323,043 | A | * | 7/1885 | Kuhlmann | 37/211 |
| 530,739 | A | * | 12/1894 | Wood | 37/209 |
| 1,225,353 | A | * | 5/1917 | Phillips | 293/48 |
| 1,432,352 | A | * | 10/1922 | Moricca | 37/217 |
| 1,755,695 | A | * | 4/1930 | Klima et al. | 37/217 |
| 2,061,585 | A | * | 11/1936 | Meyer | 37/233 |
| 2,237,891 | A | * | 4/1941 | Shipley | 37/217 |
| 2,374,312 | A | * | 4/1945 | Tackett | 172/26 |
| 4,781,121 | A | | 11/1988 | Kumar et al. | |
| 5,140,763 | A | * | 8/1992 | Nichols, IV | 37/233 |
| 5,819,443 | A | * | 10/1998 | Winter | 37/233 |
| 5,966,846 | A | * | 10/1999 | Harms et al. | 37/233 |
| 6,134,813 | A | * | 10/2000 | Vickers | 37/196 |
| 6,315,056 | B1 | * | 11/2001 | Ransom et al. | 172/246 |

* cited by examiner

*Primary Examiner*—Robert E. Pezzuto
*Assistant Examiner*—Kristine Florio
(74) *Attorney, Agent, or Firm*—Cantor Colburn LLP

(57) ABSTRACT

A method and device to further remove snow left by a locomotive snowplow while enhancing traction and control of a locomotive or powered car. The snow removal enhancement method and device typically include a flap arranged to extend beyond a bottom edge of a locomotive snowplow over each rail. The flap loosens and removes residual snow, as well as other debris, left by the snowplow. The device handily removes snow while being constructed of the thinnest material possible.

27 Claims, 7 Drawing Sheets

LOCOMOTIVE SNOW REMOVAL ENHANCEMENT

BACKGROUND OF THE INVENTION

A method and device relating generally to locomotive snow removal and, more particularly, to a flap for locomotive snow removal enhancement, wherein improved traction and control are achieved between the wheels of the locomotive and rail.

Improvement in locomotive snow removal may be achieved by enhancing the primary snow removal of a locomotive snowplow and thereby result in better traction and braking control (adhesion) available to a wheel on a rail. Pursuant to current government regulations, the distance between the locomotive snowplow and a rail top cannot be less than three inches. In practice, however, the distance between the locomotive snowplow and a rail top is typically five or more inches. Therefore, no less than five inches of snow would typically remain on a rail covered with deep snow if utilizing a locomotive snowplow alone. A secondary snow removal device that would remove at least a portion of the snow left on the rail from a locomotive snowplow would be beneficial for the reasons that follow.

There is a great need in the railroad industry to maintain adhesion and control to pull long and heavy trains, particularly when snow is left on the rails. Most of the improvements in modern locomotion to date attempting to achieve maximum adhesion have been internal to the engine and costly. Little has been done externally to improve the wheel-rail contact conditions, particularly in relation to snow on the rail. The approaches used to date include: (1) the use of a snow plow mounted on the front of the locomotive (used for over a century), and (2) an apparatus referred to as a snow blaster that uses compressed air to remove the remaining snow left by the snow plow. Both approaches are normally used in conjunction with each other, as the snow plow is typically no closer than five inches above the rail and would leave at least five inches of snow on the rails if utilized alone. Any attempt to enhance the snow removal capacity of the snow blaster as a secondary snow removal device by increasing air pressure has been inadequate due to the excess air consumption required in conjunction with the present air consumption constraints. A device that will enhance snow removal and maintain the integrity of the rail, while obtaining better traction and control, would benefit all locomotion (diesel, diesel/electric as well as electric) and provide better rail economics with improved profits.

BRIEF SUMMARY OF THE INVENTION

A method and device disclosed herein provides a solution to all of the problems discussed above. The method and device will improve wheel-rail contact and decrease operating costs when snow is further cleared from the rail. Other applications include, but are not limited to, various other rail cleaning devices, and railroad cars. The method and device relates to snow removal enhancement comprising a flap that can be mounted on or be an integral part of locomotives, powered cars or other rail vehicles for enhancing their traction and control when removing snow or other debris from a rail. The device may be mounted on the endplate behind a locomotive snowplow to work in conjunction with the snowplow and thereby reduce the amount of snow left on the rail from the snowplow. Its main benefit is the reduction in snowfall driven train stalls due to poor adhesion by enhancing the effectiveness of a locomotive snow blaster or other snow removal equipment by reducing the amount of snow left on the rail from the snowplow. Each of the snow removal enhancement embodiments is preferably mounted ahead of the lead wheel of the locomotive on each rail, although other positions may be substituted or added as conditions and desires dictate.

The method and device provide an improved means for removing snow and debris from a railroad rail surface. An exemplary embodiment further provides an improved snow removal method and device that can effectively remove snow and debris from a railroad rail yet is reliable in operation and is easily mounted and/or changed as a one-piece assembly. Furthermore, the flap does not interfere with the normal operation of the wheels. Accordingly, a preferred embodiment of the method and device provides a snow removal enhancement device for railroad surfaces (rails) that is simple (one piece assembly) and economical and is capable of clearing additional snow and debris from the railroad rail surface left by a locomotive snowplow.

In carrying out the present method and device, there is provided a snow removal enhancement device for substantially clearing snow from railroad rails comprising at least one flap mounted such that a lower portion thereof is below a lowest extension of a snow plow. An upper portion of the flap is a mounting surface attachable to a locomotive. Further features and advantages of the present device will be apparent from the following description and accompanying drawings.

BRIEF DESCRIPTION OF THE DRAWINGS

FIG. 8C is a partial rear view of a preferred embodiment in

FIG. 8B showing back support pieces;

DETAILED DESCRIPTION OF THE INVENTION

Figure 1:
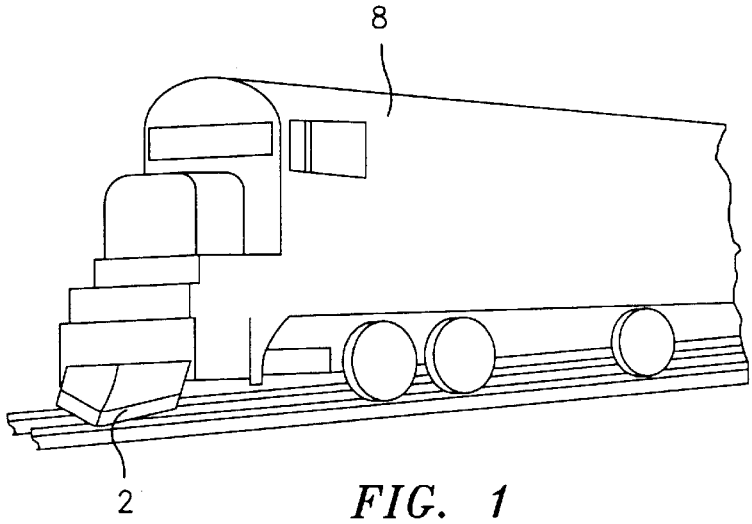
FIG. 1 is a side view of a locomotive with a snowplow.
Figure 2:
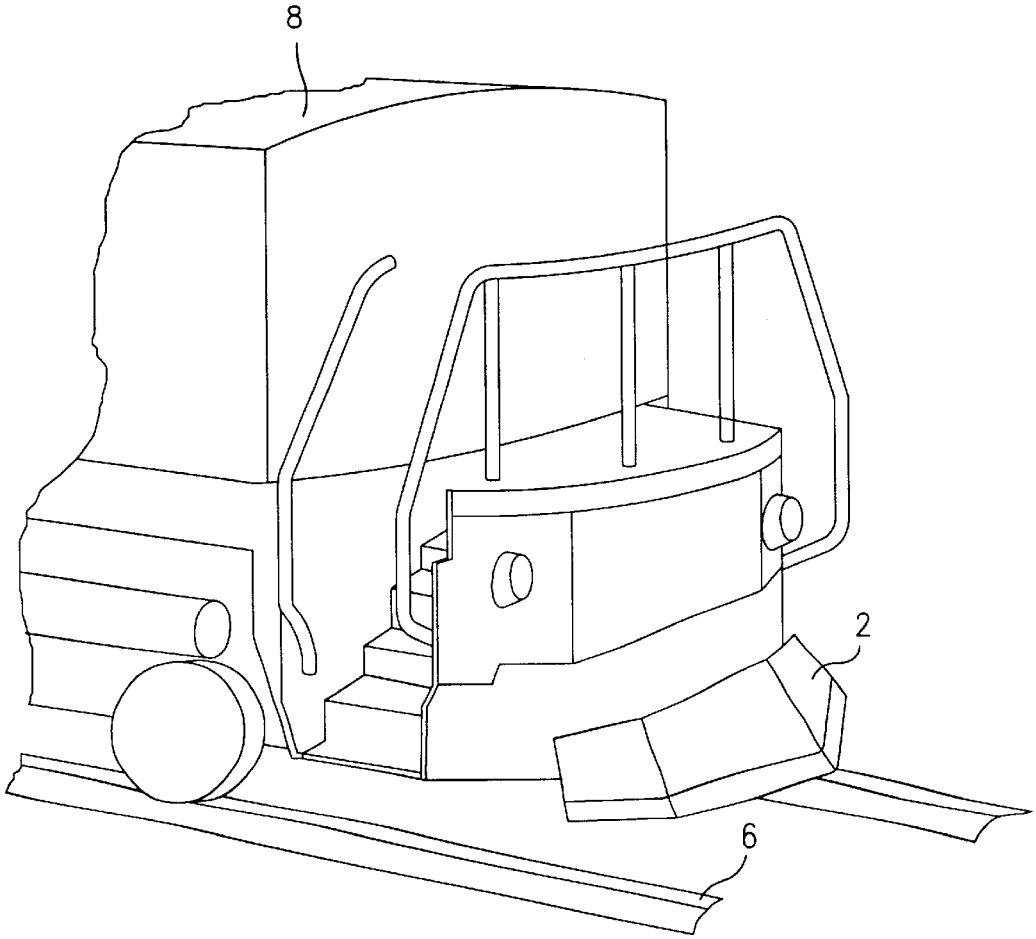
FIG. 2 is a partial front view of a locomotive with a snowplow.

Referring to FIGS. 1 and 2, a locomotive 8 on two rails 6 is shown with a front-mounted locomotive snowplow 2 that deflects a portion of settled snow from the rails 6.

Figure 3:
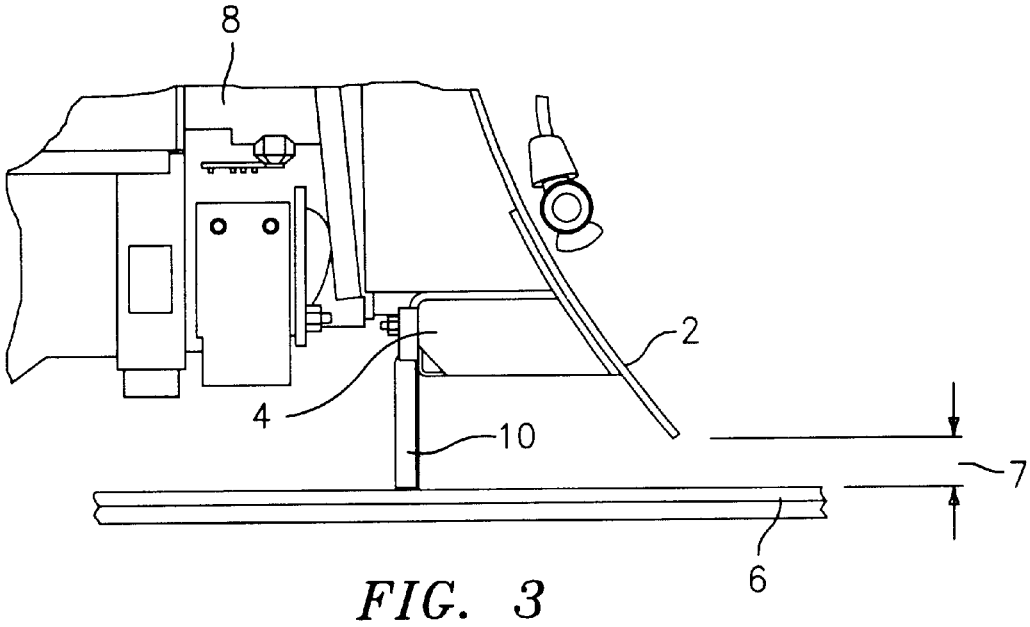
FIG. 3 is a front side view of a locomotive with a snowplow.
Figure 4:
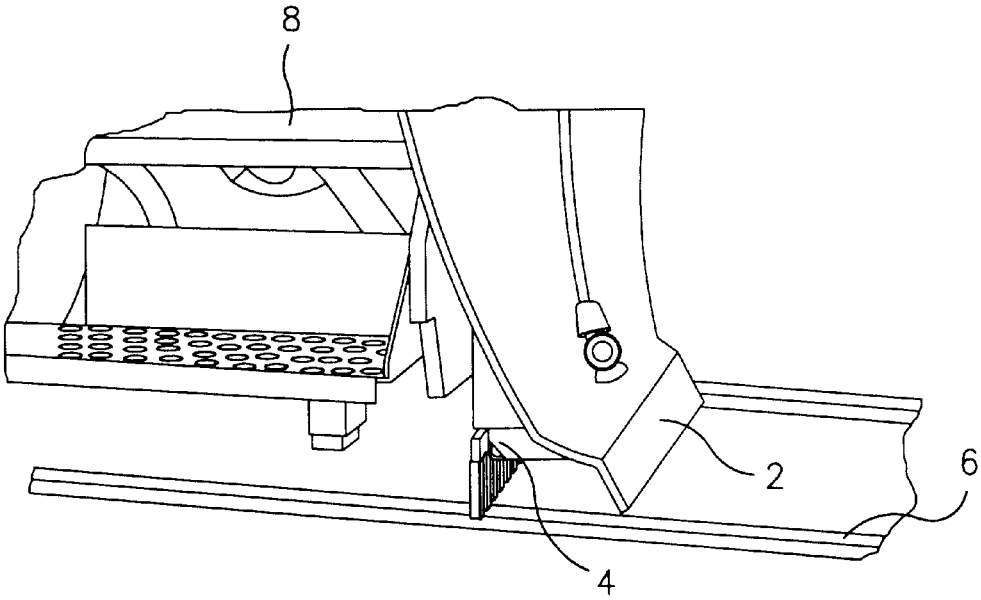
FIG. 4 is a front perspective view of a locomotive with a snowplow.

Referring to FIG. 3, a flap 10, acting as a secondary snow removal device, is mounted behind the snowplow 2 and is optionally attached to the endplate 4. The flap 10 deflects a remaining portion of settled snow from the rail 6 that the snowplow 2 has left behind because a lower edge of said snowplow 2 does not make contact with the remaining portion of settled snow. Flap 10 also deflects other debris from a rail 6 that is not large enough to make contact with at least the lower edge of snowplow 2.

Figure 10:
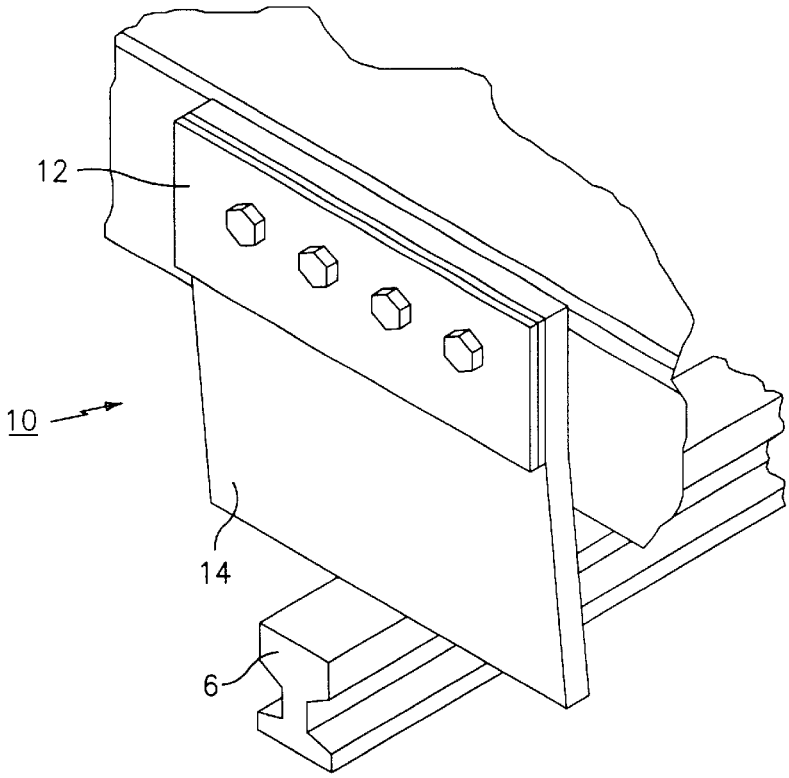
FIG. 10 is a rear perspective view of an alternative embodiment of a non-corrugated flap.
Figure 11:
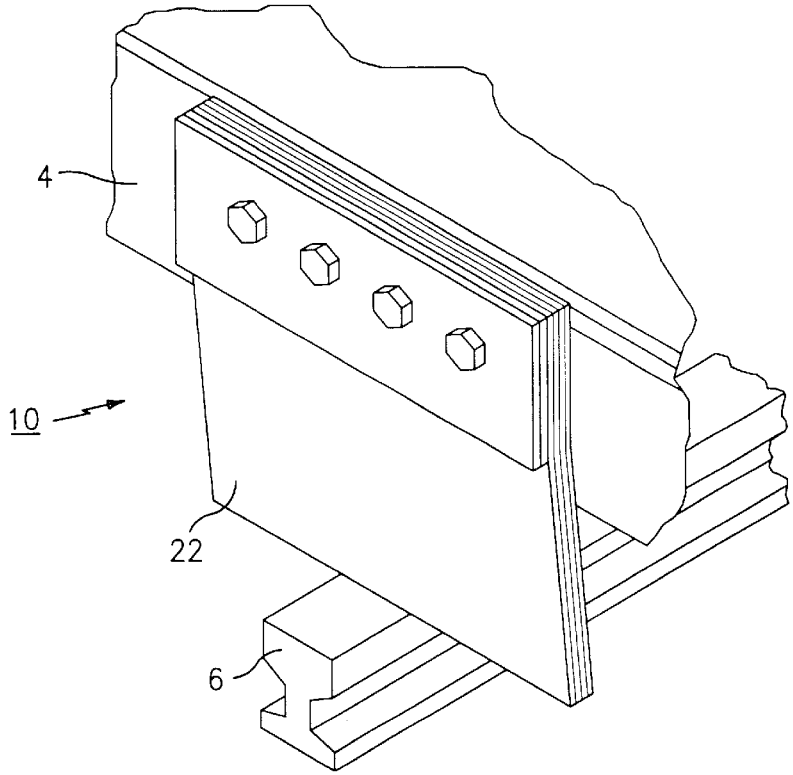
FIG. 11 is a rear perspective view of an alternative embodiment of a flap.

A device for locomotive snow removal enhancement utilizes a flap 10 that is substantially rectangular in shape and is substantially at least as wide as a rail 6 on which a locomotive wheel travels. Preferred embodiments have the flap wider than a rail top to accommodate operation on track curves. The flap 10 is mounted to a locomotive 8 over a rail 6 and is preferably constructed of one piece and one material for ease of manufacture, installation and replacement. In a preferred embodiment, the flap is mounted on the endplate 4 behind a locomotive snowplow 2. One exemplary embodiment is substantially flat as illustrated in FIG. 10. Another alternative exemplary embodiment uses multiple pieces 22 to form the flap 10 (See FIG. 11). Flap 10 further comprises material characteristics that do not interfere with the normal operation of wheels of a locomotive should the flap disengage. Moreover, the material characteristics of the flap 10 do not interfere with the wheels as the wheels engage the rail 6 should a flap 10 fall onto a rail 6. The flap is configured and dimensioned to minimize potential wheel displacement relative to the rail should a flap come between a wheel and the rail. A preferred material characteristic of the flap to minimize potential wheel displacement includes a flap having a thickness as thin as possible, yet stiff enough to sufficiently deflect snow and other debris when mounted to the locomotive. The material of a flap 10 that extends lower than a bottom edge of a locomotive snowplow 2 is within current regulations governing material for such structures that extend lower than a snowplow 2. The material thickness is 0.125 inch thick 20 in a preferred embodiment shown in FIG. 7. Alternative embodiments that essentially offer material characteristics similar to a thin material include a pliable material or a crushable/collapsible material when detached that minimize wheel displacement when a flap comes between a wheel and a rail. For example, a pliable material such as urethane may be used that will be compliant enough when detached to conform around a rail surface and maintain the relative displacement of the wheel in relation to the rail and limit the wheel displacement in both horizontal and vertical directions. Other alternative embodiments of the flap 10 include utilization of a metal material, such as steel, provided that the material and configuration allow a fallen flap 10 to conform around the rail, thus limiting wheel displacement as when using the pliable material discussed above. In an alternative embodiment, a flap having a honeycomb, box and channel cross-section or any infrastructure matrix that is crushable, yet provides sufficient stiffness when mounted to the locomotive also provides a material characteristic that is desirable. The infrastructural matrix provides the rigidity necessary to deflect settled snow and other debris when fixedly secured to the locomotive while providing a crushable thickness should the flap detach and come between a wheel and the rail. The weight of the locomotive acting through the wheels would effectively crush the infrastructural matrix and reduce the thickness of the flap, thus reducing the displacement of the wheels in relation to the rail.

The flap 10 further comprises a resistance to bending when attached to the locomotive for deflecting settled snow deposited on a rail and other debris not removed by a locomotive snowplow 2. The resistance to bending is increased by configuring the flap without changing the flap's dimensions (i.e., thickness) by increasing the moment of inertia relative to an axis as is known in the art. One such configuration that increases the moment of inertia of a substantially planar configuration includes a flap having corrugation. Preferred embodiments include a relatively thin corrugated lower portion 14 of a flap 10 to increase strength and rigidity of the flap, however, the entire flap may be corrugated as well.

Turning to FIGS. 4, 5, 6, and 7, a snow removal enhancement method and device is disclosed that utilizes a locomotive 8 having a locomotive snowplow 2 and a flap 10 attached to the locomotive 8 in front of any wheels of the locomotive 8 to provide increased snow removal and increase available wheel-rail adhesion over that obtained with utilizing the snowplow 2 alone. The flap 10 comprises an upper portion 12 for mounting to a locomotive 8, typically on an endplate 4, and a lower portion 14 for clearing snow and other debris from the rail 6. The snow removal device provides increased snow removal from a rail 6 and offers better wheel-rail adhesion with such increased snow removal.

Figure 5:
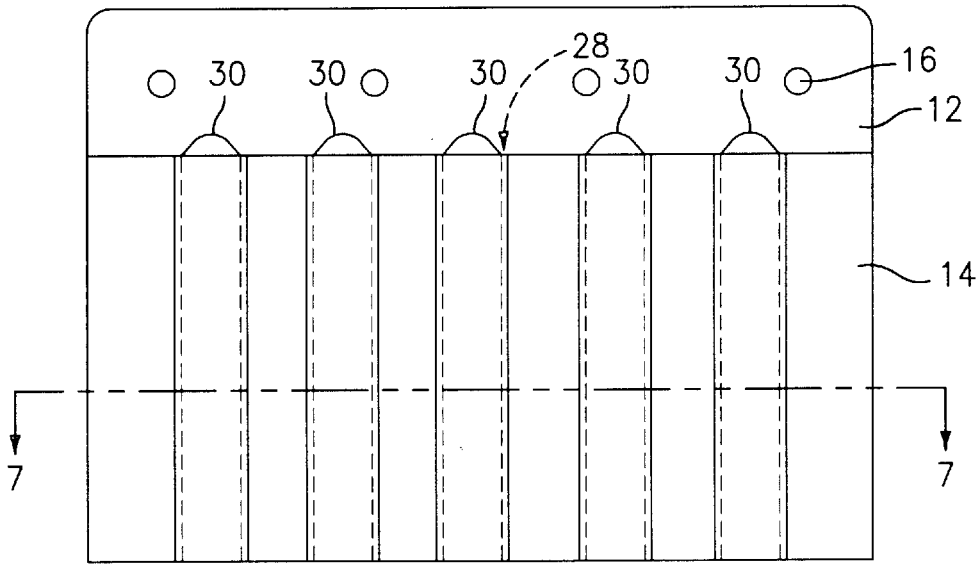
FIG. 5 is a front/plan view of a preferred embodiment of a flap.
Figure 7:
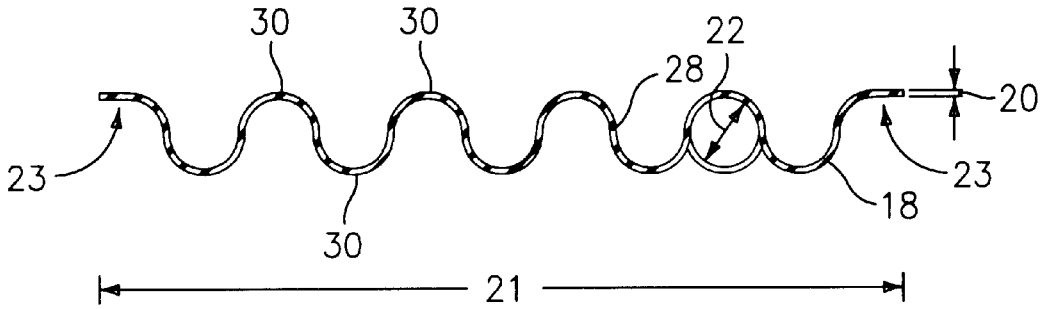
FIG. 7 is a cross-sectional view of a preferred embodiment of a flap.
Figure 8B:
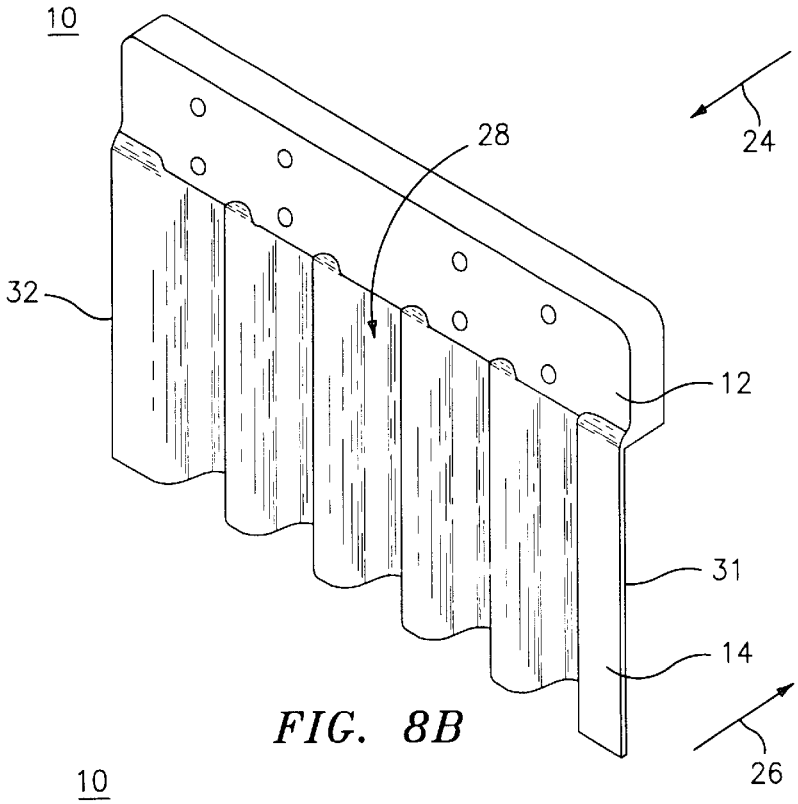
FIG. 8B is a perspective view of a preferred embodiment of a flap.
Figure 9:
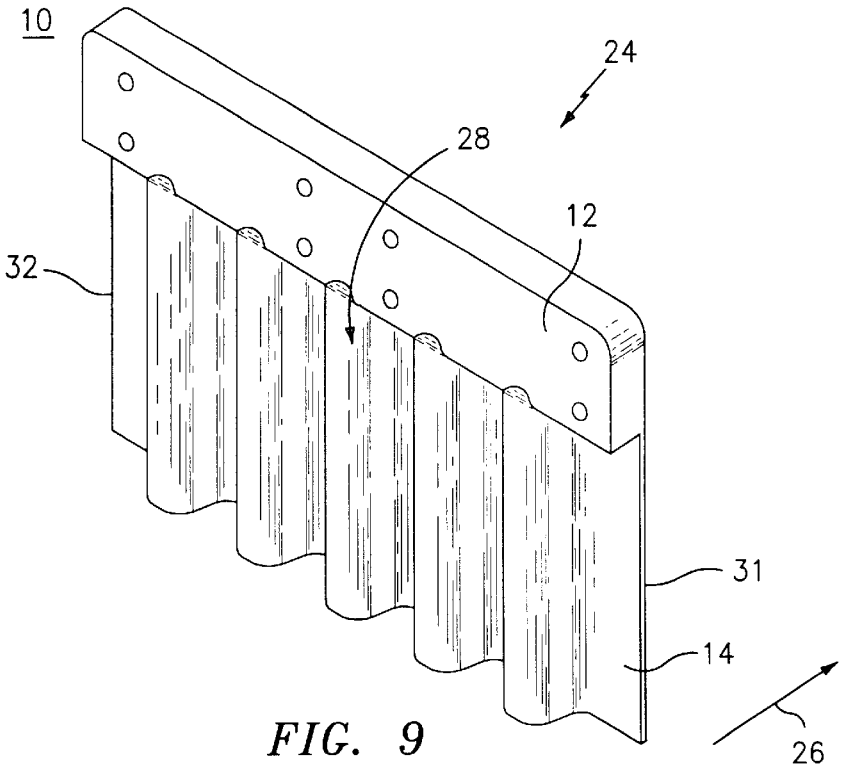
FIG. 9 is a perspective view of an alternative embodiment of a flap.

An exemplary embodiment is shown with the lower portion 14 of a flap 10 corrugated having folds 30, wherein said folds are substantially parallel to a vertical axis 28 (FIGS. 5 and 7). Referring to FIG. 8B, an exemplary embodiment of the device is illustrated in a rear perspective view of the device showing an incoming snow direction 24 relative to the flap 10 that is opposite to a travel direction 26 of the locomotive 8. FIG. 8B also illustrates that the lower portion 14 of the flap 10 is corrugated in a preferred direction along axis 28 to increase the strength and rigidity of the lower portion 14 that is in contact with snow or debris. Furthermore, it will also be understood that an exemplary embodiment of the flap has a corrugated lower portion with both a right edge 31 and a left edge 32 of the flap oriented as shown in FIG. 8B, where edges 31 and 32 are in an outside plane opposite and parallel to the other outside plane that first meets the incoming snow 24, the said edges 31 and 32 may also be oriented in a reverse direction as illustrated in FIG. 9, where edges 31 and 32 are in an outside plane that coincides with a plane that first meets the incoming snow 24. In previous field tests, the corrugation turned in the direction relative to incoming snow 24 as illustrated in FIG. 8B was more effective at plowing snow away from a locomotive wheel.

The upper portion 12 of a flap 10 that does not extend below a locomotive snowplow 2 is typically thicker than the lower portion 14 and typically non-corrugated in preferred embodiments as illustrated in FIGS. 5, 6, 7, 8, and 9. However, it should be noted that the upper portion 12 material thicknesses may be limited when available space is minimal for mounting the flap 10 preferably on a locomotive endplate 4 behind a locomotive snowplow 2. In an exemplary embodiment, the upper portion 12 of a flap 10 further comprises at least one opening 16 for attachment to a locomotive 8. In a preferred embodiment, the upper portion 12 of a flap 10 comprises four openings having a rigid lining (not shown) in each opening to prevent compression and deformation of the flap when firmly fastening the flap to a locomotive 8 with compressive fasteners (e.g., threaded fasteners). The rigid lining may be a metal insert pressed into the opening 16 for a bolt to pass through when attaching the flap 10 in an exemplary embodiment. A material from which the flap 10 is made is preferably a substantially rigid material. However some resilience in the material is acceptable. In a preferred embodiment, utilization of urethane having a durometer of Shore A 95 has proven successful. A primary benefit of the corrugation is the utilization of a relatively thin material, substantially limiting any interference with the normal operation of the wheels as the wheels engage the rail if a corrugated flap portion falls on the rail.

Figure 12:
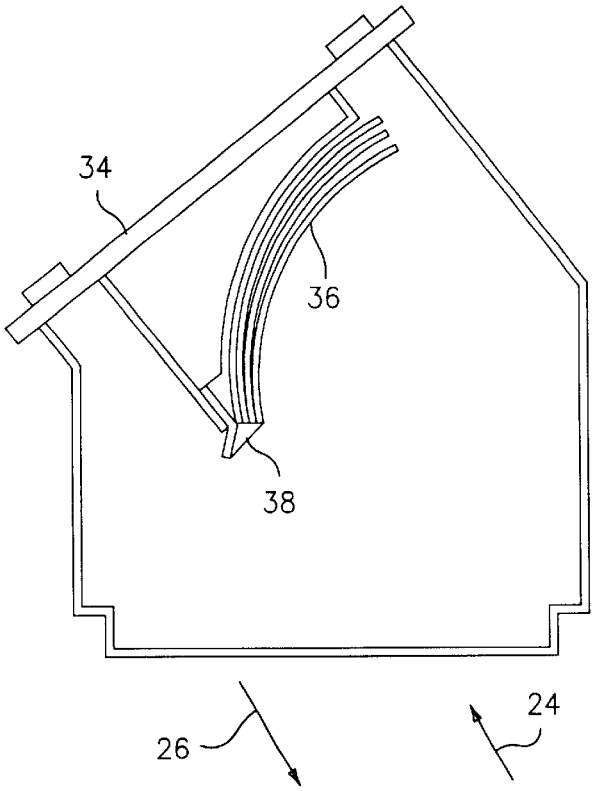
FIG. 12 is a top view of an alternative embodiment of a flap.

Another alternative embodiment is shown in FIG. 12. A locomotive snow removal enhancement device comprises a fixture assembly 34 attachable to a locomotive 8 and a flap 10 that extends over substantially the entire width of a rail 6 and mounted to the fixture assembly 34. An exemplary alternative embodiment further comprises a curved flap 36 mounted to the fixture assembly 34, wherein the curved flap 36 is concave to a direction of travel of the locomotive 26 and extends over substantially an entire width of a rail 6. The concavity of the flap 10 is defined by first and second lateral edges of the flap being out of plane with a vertical median of the flap, the edges being out of plane in the same direction as one another from the plane of the median. The curved flap is further defined by one of the first and second lateral edges being located inboard and more forward than the other relative to a direction of travel of said locomotive 26.

Figure 6:
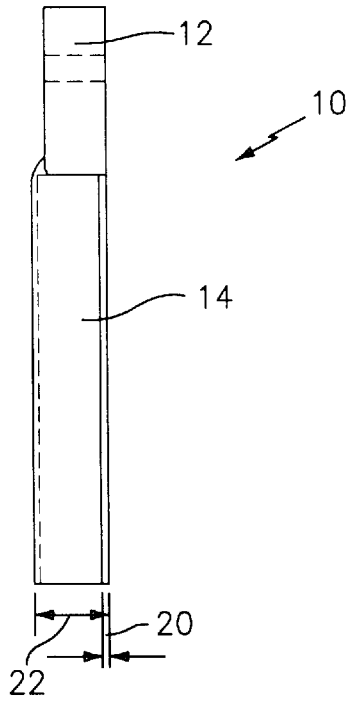
FIG. 6 is a side view of a preferred embodiment of a flap.
Figure 8A:
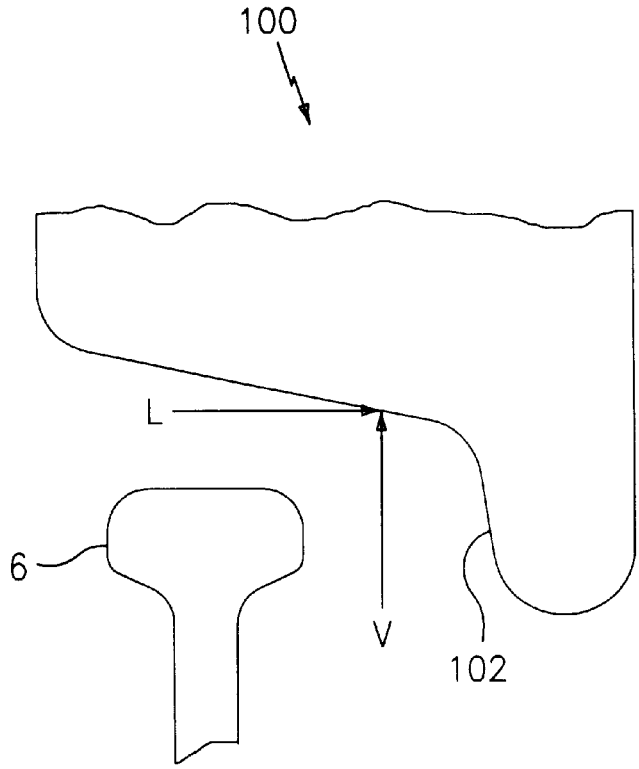
FIG. 8A is an illustration depicting vertical and horizontal force of a locomotive wheel.

Referring to FIGS. 5, 6, and 7, a snow removal enhancement device, preferably a one-piece flap 10, is mounted on a locomotive 8 such that a width of the flap substantially extends above a substantial width of a rail 6 to remove snow and debris left by a locomotive snowplow 2, as the flap 10 is disposed closer to a rail 6 than the snowplow 2. FIG. 3 shows a distance 7 between a bottom edge of the snowplow 2 and a top portion of a rail 6, which also represents the amount of snow left on a rail after a snowplow 2 passes. Utilization of a flap 10 wherein at least the lower portion 14 thereof is not thick enough to cause interference with the normal operation of the wheels as they engage the rail should the lower portion 14 of the flap 10 fall onto a rail 6 is preferred. Referring to FIG. 7, a preferred embodiment utilizes a material thickness of 0.125 inch 20 urethane material that limits virtually any interference with the normal operation of the wheels with the rail should the flap fall on the rail and come between a wheel and the rail. Locomotive Dynamics Simulation tests (Adams Models & Control Environment Track Test) were conducted yielding no affect with normal operation of the wheels on the rail when traveling at 10 mph and 70 mph on different track possibilities utilizing a flap 10 wherein the lower portion 14 thereof was 0.125 inch thick. The predicted wheel displacement ratios (L/V) during these tests were found to have much lower values than the allowable value of 1.0, pursuant to AAR Regulations, Chapter 11, where:

$$\frac{L}{V} = \frac{\text{lateral(force)}}{\text{vertical(force)}}$$

of a wheel as illustrated in FIG. 8A.

FIG. 8A depicts a portion of a rail vehicle wheel 100 positioned on a rail 6 with arrows showing a lateral force direction (L) and a vertical force direction (V) of translation for a rail vehicle wheel 100 when an object falls onto the rail 6 and becomes disposed under a wheel 100 that is in motion. When an L/V value is less than 1, simple physical analysis shows that the rail vehicle is less prone to interference of the normal operation of the wheels engaging the rail as the wheel flange 102 of wheel 100 is contained by a vertical edge of the rail 6. The results of the testing of a corrugated flap show that a flap utilizing 0.125 inch thick corrugation is capable of providing the structural integrity necessary to remove settled snow from a rail while limiting a potential interference of the normal operation of the wheels engaging the rail in the event the corrugated flap detached and fell on a rail.

Figure 8C:
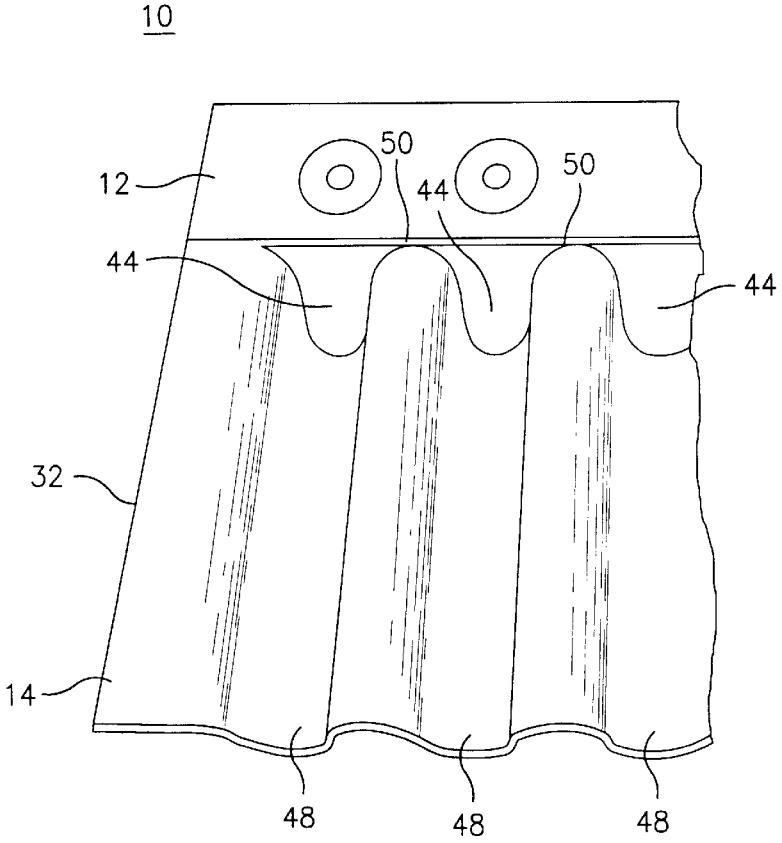

Turning to FIG. 8C, an exemplary embodiment shown in FIG. 8B depicts back support members 44 disposed within each valley portion 48 of corrugation on one side, preferably a backside, of the flap 10. The back support members 44 are part of a mold for a flap 10. Each back support member 44 provides support and rigidity where upper portion 12 joins lower portion 14. Each back support member 44 is tapered as a result of each member 44 being as thick as the upper portion 12 at a base portion 50 of member 44 and tapering down in thickness as each back support member extends and joins to valley portion 48 in the corrugated lower portion 14. Back support members reduce the risk of premature detachment at a junction where the thicker upper portion meets the thinner corrugated lower portion of the flap by increasing the support and rigidity at this junction by addition of these support members in the corrugation valleys on the backside of the flap.

Referring to FIG. 9, an exemplary embodiment of the method and device comprises increasing the life and longevity of a flap 10 when attaching behind a locomotive snowplow 2 and further comprises having at least a lower portion 14 that is corrugated in a longitudinal direction 28 to increase the strength and rigidity of the flap. The increase in strength and rigidity obtained by corrugating at least the lower portion 14 of the flap 10 may be illustrated with the equations that follow relative to stress ($\sigma_{max}$) and deflection ($\delta$) and are well known in the art. Stress and deflection are inversely proportional to the moment of inertia of the cross-section as follows:

$$\sigma_{\max} = \frac{Mc}{I}$$

$$\delta = \frac{PL^3}{3EI}$$

where M is an applied moment, c is the maximum distance from a neutral axis, L is the length of the cantilever, E is the elastic modulus, P is the applied force, and I is the moment of inertia.

With a corrugated pattern on at least the lower portion 14 of a flap 10, as illustrated in FIG. 6 showing a cross-sectional view, the moment of inertia is greatly increased. For example, utilizing a 1.5 inch OD curve 22 in relation to the corrugated portion 18 and a 0.125 inch thickness 20 and a 16 inch wide flap 21 (as shown in FIGS. 6 and 7), the moment of inertia calculates to be 0.764 $in^4$ using the parallel axis theorem and dividing the composite flap into three constituent parts. The three constituent parts consisted of the outer corrugation having an outer radius of 0.75 in., the inner corrugation having an inner radius of 0.625 in., and the two end flaps 23. The moment of inertia of each constituent part was calculated and added together to find the total about a center axis of the flap. The moment of inertia for a corrugated flap is 197 times greater than that calculated for the same material thickness without the corrugation 18 (i.e., 0.00388 $in^4$). The moment of inertia for a noncorrugated flap is calculated utilizing a standard equation (i.e., Flat flap $I=1/12bh^3$). The stress and deflection are accordingly decreased by a factor of 197 because of the inverse proportional relationship; therefore, corrugation greatly increases the strength and stiffness of the flap 10 without changing the thickness of a flap 10. By locating a flap 10 behind a locomotive snowplow 2, larger debris will be removed by the snowplow 2 without impacting and damaging the flap 10. Furthermore, with at least a lower portion 14 of the flap 10 being corrugated, the strength and stiffness are greatly enhanced to protect a flap 10 when impacting snow and debris not cleared by a locomotive snowplow 2. The greater strength and stiffness obtained with corrugation will enhance snow removal while not affecting normal operation of the wheels engaging the rail and without using a thicker flap 10.

A method is also disclosed herein for locomotive snow removal enhancement after a locomotive snowplow 2 leaves residual snow on a rail 6 by utilizing a locomotive snow removal enhancement device mounted at a specific orientation that is closer to a rail 6 than a locomotive snowplow 2. The locomotive snow removal enhancement device removes an increased amount of snow before a locomotive wheel, preferably a drive wheel, makes contact with that portion of the rail 6, thereby reducing the amount of snow for any other snow removal device to remove, and further increasing available traction to the locomotive wheel.

A method for locomotive snow removal enhancement by increasing snow removal from a rail 6 on which a locomotive 8 travels comprises: utilizing a locomotive 8 having a front mounted locomotive snow plow 2 acting as a primary snow removal device; removing additional snow left by the snowplow 2 from a rail 6 on which the locomotive 8 travels; and attaching a secondary snow removal enhancement device, such as a flap 10, at a specific orientation that is disposed above and near a rail 6 and behind a locomotive snowplow 2, whereby said device removes snow and debris from a rail 6 left by said snowplow 2, thereby increasing snow removal, reducing the amount of snow for any other snow removal device to remove, and improving traction available to a locomotive wheel, preferably a drive wheel, on a rail 6 after a locomotive snowplow 2 leaves an amount of snow on the rail 6.

While preferred embodiments have been shown and described, various modifications and substitutions may be made thereto without departing from the spirit and scope of the method and device. Accordingly, it is to be understood that the present method and device has been described by way of illustration and not limitation.

What is claimed is:

1. A snow removal flap for a locomotive having sets of wheels and a snow plow ahead of a front set of locomotive wheels for removing snow left in place on a railroad rail by the snow plow, the flap comprising:

a generally elongate member constructed to be of generally high rigidity and mechanical strength along a first axis generally parallel to a top of the rail to reset bending of the flap as the flap removes snow from the rail and to be of generally tow rigidity and mechanical strength along other axes so as to be deformable by the locomotive wheels if the flap becomes detached from the locomotive and comes to be positioned between the wheels and the rail, the member comprises:

an upper portion operably secured to an underside of the locomotive; and a lower portion operably positioned below a bottom edge of the snowplow and adjacent the rail, with the member extending down from said upper portion thereof toward but stopping short of the railroad rail, with the member being positioned behind the snow plow and ahead of the respective locomotive wheel.

2. The snow removal flap of claim 1 wherein said upper portion is a thicker material than said lower portion.

3. The snow removal flap of claim 2 wherein said lower portion is of generally corrugated construction with ridges and recesses of the corrugation extending generally vertically.

4. The snow removal flap of claim 3 being formed of metal.

5. The snow removal flap of claim 4 being formed of steel.

6. The snow removal flap of claim 1 wherein said flap is formed at least in part of corrugated construction.

7. The snow removal flap of claim 1 wherein said upper portion includes openings therein to receive fasteners for securing the flap to the locomotive.

8. The snow removal flap of claim 1 wherein said lower portion extends at an acute angle to a direction of travel of the locomotive along the rail.

9. The snow flap of claim 1 having material characteristics that do not interfere with the normal operation of locomotive wheels should said flap detach from said locomotive wherein said material characteristics minimize said locomotive wheels relative displacement should said flap fall onto a rail, said relative displacement of said locomotive wheels have a lateral/vertical displacement value less than about 1, said flap extending toward but stopping short of the railroad rail.

10. The device according to claim 9 further comprising a locomotive snowplow, wherein said material characteristics of said flap include having a property of resistance to bending sufficient to deflect settled snow that is not removed by a locomotive snowplow.

11. The snow flap of claim 1 having material characteristics that do not interfere with the normal operation of locomotive wheels should said flap detach from said locomotive wherein said material characteristics includes a thickness that does not exceed about 0.125 inch, said flap extending toward but stopping short of the railroad rail.

12. The snow flap of claim 1 having material characteristics that do not interfere with the normal operation of locomotive wheels should said flap detach from said locomotive wherein said material characteristics include a permanently collapsible structure said permanently collapsible structure is an infrastructural matrix.

13. The snow flap of claim 1 having material characteristics that do not interfere with the normal operation of locomotive wheels should said flap detach from said locomotive wherein said material characteristics include a pliable material when said flap is not fixedly secured to a locomotive, said pliable material conforms to a rail surface should a locomotive wheel run over said flap.

14. A device for locomotive snow removal enhancement comprising:

a flap extending below a lower edge of a locomotive snowplow, said flap including:

an upper portion operably attached to said locomotive, and a lower portion extending from said upper portion, wherein said lower portion has a resistance to bending and is configured and dimensioned for normal operation of locomotive wheels should said lower portion detach from said upper portion operably attached to said locomotive wherein said lower portion is corrugated to increase strength and rigidity without increasing thickness.

15. The device according to claim 14 wherein said upper portion has a resistance to bending and is configured and dimensioned for normal operation of locomotive wheels should said upper portion detach from said locomotive.

16. The device according to claim 14 wherein said upper portion is configured and dimensioned for mounting said flap to a structure of a locomotive, said flap extending toward a rail and being within close proximity thereof.

17. The device according to claim 14 wherein said flap is disposed above at least a substantial width of a rail surface.

18. The device according to claim 14 wherein said upper portion further includes at least one opening for mounting said flap to a structure of a locomotive, said flap extending toward said rail and within close proximity thereof.

19. The device according to claim 18 wherein said at least one opening further comprises a rigid lining therein.

20. The device according to claim 14, wherein said upper portion and said lower portion is corrugated.

21. The device according to claim 14, wherein said upper portion is thicker than said lower portion.

22. The device according to claim 21, wherein said corrugated lower portion includes a back support member extending from each valley portion of corrugation on one side of said flap and depends from a lower surface of said upper portion.

23. The device according to claim 22 wherein said back support member is configured having a base depending from said lower surface and as thick as said upper portion and further configured to taper in thickness as it extends and joins to each said valley portion.

24. The device according to claim 23 wherein said upper portion includes at least one opening.

25. The device according to claim 24, wherein said at least one opening includes a rigid lining therein.

26. A device for locomotive snow removal enhancement comprising:

a locomotive snowplow;

a flap having a lower portion and an upper portion, at least said lower portion extending below a lower edge of a locomotive snowplow;

an area in said upper portion for mounting said flap, said flat extending toward a rail and within close proximity thereof; and a fixture assembly attachable to a locomotive and attachable to said area, wherein at least said lower portion of said flap is substantially curved, said flap is concave to a direction ahead of a direction of travel of a wheel of said locomotive;

wherein said concavity of said flap is defined by first and second lateral edges of said flap being out of plane with a vertical median of said flap, said edges being cut of plane in the same direction as one another from said plane of said median, and wherein one of said first and second lateral edges is located more forward than the other of said first and second lateral edges relative to a direction ahead of a direction of travel of a wheel of said locomotive.

27. The device according to claim 26, wherein said edge located more forward is one of said first and second lateral edges that is also located more inboard relative to said locomotive than the other of said first and second edges.

* * * * *